US008057257B2

(12) United States Patent
Chen et al.

(10) Patent No.: US 8,057,257 B2
(45) Date of Patent: Nov. 15, 2011

(54) DUAL TYPE BNC CONNECTOR

(75) Inventors: Sung-Wen Chen, Hsin-Tien (TW); Tung-Liang Huang, Hsin-Tien (TW)

(73) Assignee: Insert Enterprise Co., Ltd, New Taipei (TW)

( * ) Notice: Subject to any disclaimer, the term of this patent is extended or adjusted under 35 U.S.C. 154(b) by 262 days.

(21) Appl. No.: 12/076,604

(22) Filed: Mar. 20, 2008

(65) Prior Publication Data

US 2009/0197462 A1 Aug. 6, 2009

(30) Foreign Application Priority Data

Feb. 5, 2008 (TW) ..... 97202627 U

(51) Int. Cl.
*H01R 13/60* (2006.01)

(52) U.S. Cl. ..... 439/541.5; 439/581

(58) Field of Classification Search ..... 439/620.3, 439/620.9, 541.5, 581, 63
See application file for complete search history.

(56) References Cited

U.S. PATENT DOCUMENTS 5,336,109 A * 8/1994 Hillbish et al. ..... 439/541.5
5,613,880 A * 3/1997 Wang ..... 439/620.03
5,730,621 A * 3/1998 Wang ..... 439/541.5
6,234,833 B1 * 5/2001 Tsai et al. ..... 439/541.5
7,014,480 B1 * 3/2006 Weidner et al. ..... 439/95

* cited by examiner

*Primary Examiner* — Xuong Chung Trans

(57) ABSTRACT

A dual type BNC connector comprises an insulating housing, two BNC plugs and a plurality of conducting wires; a rear end of the housing is disposed with at least one pick-up plate; the pick-up plate is disposed with a plurality of engagement grooves; the plurality of engagement grooves are respectively engaged with the plurality of conducting wires electrically connected to at least one BNC plug to allow the plurality of conducting wires to be respectively retained at specific positions, not to inclined to influence the stability of the signal transmission and not to contact one another to form a short circuit and to be convenient for being respectively inserted into a plurality of slots on a circuit board simultaneously.

4 Claims, 7 Drawing Sheets

DUAL TYPE BNC CONNECTOR

BACKGROUND OF THE INVENTION

1. Field of the Invention

The present invention relates to an electric connector, and more particularly to a dual type BNC connector.

2. Description of Related Art

There are many patents concerning a dual type BNC connector. For example, Taiwan Patent No. M241844 entitled as "Dual type BNC connector", Taiwan Patent No. M270544 and U.S. Pat. No. 7,186,138 entitled as "Multiple pieces dual type BNC connector with all metal shell", Taiwan Patent No. M270543 and U.S. Pat. No. 7,014,503 entitle as "Multiple pieces dual type BNC connector", Taiwan Patent Publishing No. 267610 and U.S. Pat. No. 5,613,880 entitled as "Dual-plug BNC connector".

Please refer to FIGS. 6A, 6B and 6C. A plurality of conducting wires 11, 12, 13 and 14 bent 90 degrees to a side of a housing 100 of a dual type BNC connector 10 are disposed on a rear end thereof. Ends of the plurality of conducting wires 11, 12, 13 and 14 are respectively electrically connected a signal terminal 15 and a metal housing 16, other ends thereof are extended out of the dual type BNC connector 10 and used for inserting into corresponding slots on a circuit board. The plurality of conducting wires 11, 12, 13 and 14 placed at the rear end of the dual type BNC connector 10 mentioned above are not fixed on the housing 100, pins 111, 121, 131 and 141 of the plurality of conducting wires 11, 12, 13 and 14 are always not aligned with the plurality of slots of the circuit board simultaneously; spacing intervals of the plurality of pins 111, 121, 131 and 141 must be first adjusted and can then be inserted into the plurality of slots during assembly, it wastes the labor and time. Furthermore, the plurality of conducting wires 11, 12, 13 and 14 may not be parallel to one another very well (inclined to one another) such that the stability of the signal transmission is influenced and a short circuit is generated due to the mutual contact among them. Also mounting grooves can be made on the housing to hold the plurality of conducting wires, but the plurality of conducting wires can not be respectively retained at specific positions.

Please refer to 7A, 7B and 7C. Another conventional dual type BNC connector 20 is approximately the same as the conventional dual type BNC connector 10 mentioned above, But, a housing 200 of the dual type BNC connector 20 is disposed with a hole 201 used for accepting a capacitor 202. A conducting sheet 203 is coupled to the housing 200 through two retaining elements 204 to shield the hole 201; one end of the capacitor 202 contacts a metal shell 21 and another end thereof contacts the conducting sheet 203. The capacitor 202 is used for filtering noise in electric signals. A plurality of conducting wires 22, 23, 24 and 25 of the dual type BNC connector are also fixed on the housing 200. Therefore, they have the same deficit as the plurality of conducting wires 11, 12, 13 and 14 of the dual type BNC connector 10 mentioned above.

SUMMARY OF THE INVENTION

For improving the deficit caused from a plurality of unfixed conducting wires at a rear end of a dual type BNC connector, the present invention is proposed.

The main object of the present invention is to provide a dual type BNC connector, allowing conducting wires connected to a rear end thereof to be fixed so as to be convenient for pins of the plurality of connected conducting wires to be respectively inserted into a plurality of slots on a circuit board simultaneously.

Another object of the present invention is to provide a dual type BNC connector, allowing conducting wires connected to a rear end thereof to be fixed at specific positions, rather not to be inclined to influence the stability of the signal transmission and not to contact one another to generate a short circuit.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1C:
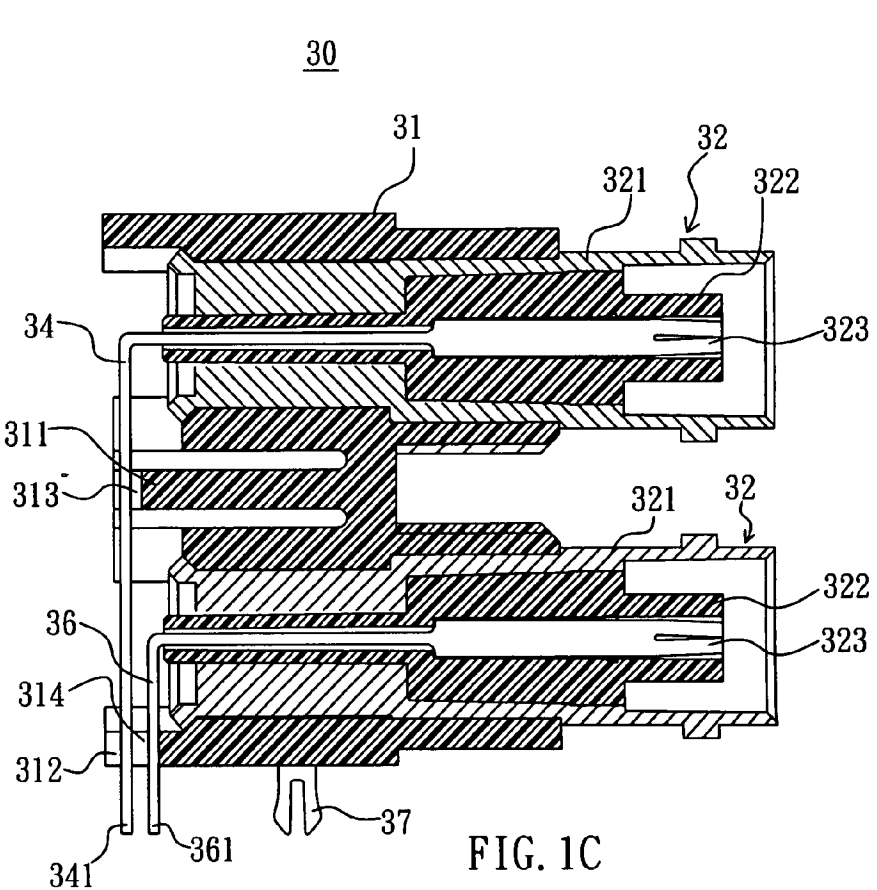
FIG. 1C is a cross sectional view, showing a dual type BNC connector of the first embodiment according to the present invention.
Figure 1A:
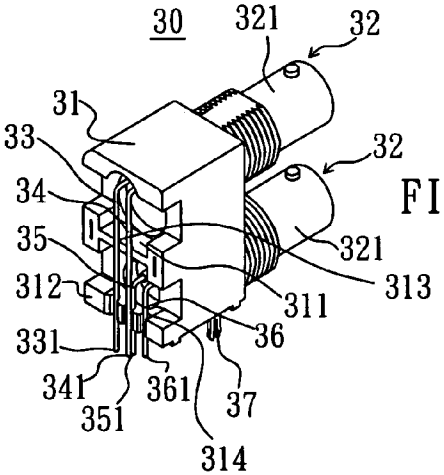
FIG. 1A is a perspective view, showing a dual type BNC connector of a first preferred embodiment according to the present invention.
Figure 1B:
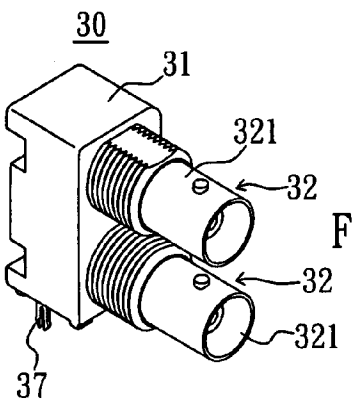
FIG. 1B is another perspective view, showing a dual type BNC connector of the first embodiment according to the present invention.

Please refer to FIGS. 1A to 1C. FIGS. 1A to 1C show a dual type BNC connector 30 of the first preferred embodiment according to the present invention. The dual type BNC connector 30 comprises a housing 31, two BNC plugs 32, a plurality of conducting wires 33, 34, 35 and 36 and an insertion element 37. The housing 31 is made from an insulating material by means of mold injection. The two BNC plugs 32 are parallel to each other. The BNC plug 32 comprises a metal shell 321, a hollow insulator 322 and a signal terminal 323. A rear section of the metal housing 321 is coupled to the housing 31, a front section of the metal shell 321 is extended out of the housing 31. An inner part of the metal shell 321 is coupled to the insulator 322, an inner part of the insulator 322 is coupled to the signal terminal 323. Ends of a plurality of conducting wires 33, 34, 35 and 36 are respectively electrically connected to the metal shell 321 and the signal terminal 323; other ends of the plurality of conducting wires 33, 34, 35 and 36 are extended out of one side of the housing 31 to form a plurality of pins 331, 341, 351 and 361 used for inserting into corresponding slots on a circuit board to enable the BNC plug to be electrically connected to the circuit board. The insertion element 37 is assembled on the housing 31 and used for assembling the housing 31 onto the circuit board. A rear end of the housing 31 is disposed with a first pick up plate 311 and a second pick up plate 312. The first pick up plate 311 and the second pick up plate 312 are respectively disposed with a plurality of engagement grooves 313 and a plurality of engagement grooves 314. The plurality of engagement grooves 313 of the first pick up plate are respectively engaged with the two conducting wires 33 and 34 electrically connected to one of the BNC plug 32, and the plurality of engagement grooves 314 of the second pick up plate 312 are respectively engaged with the plurality of conducting wires 33, 34, 35 and 36 electrically connected to the two BNC plugs 32 to cause the plurality of conducting wires 33, 34, 35 and 36 to be respectively retained at specific positions, not to be inclined to influence the stability of the signal transmission and not to contact one another to form a short circuit. Moreover, the pins 331, 341, 351 and 361 of the plurality of conducting wires 33, 34, 35 and 36 are allowed to retain at positions corresponding to the plurality of slots on the circuit board to be convenient for allowing them to be respectively inserted into the plurality of slots on the circuit board simultaneously.

Figure 2C:
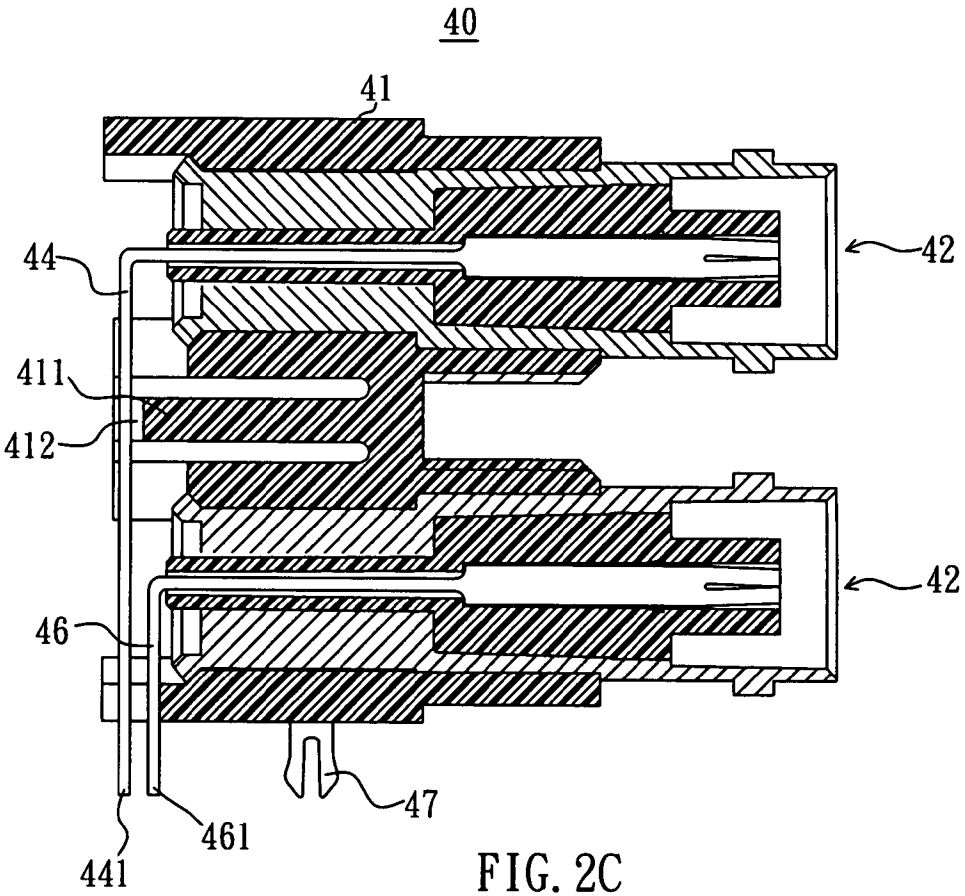
FIG. 2C is a cross sectional view, showing a dual type BNC connector of the second embodiment according to the present invention.
Figure 2A:
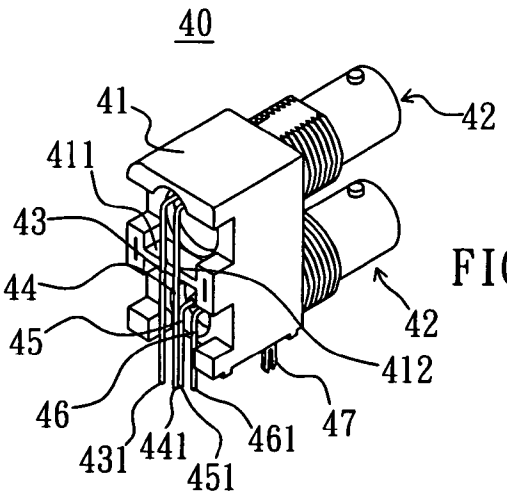
FIG. 2A is a perspective view, showing a dual type BNC connector of a second preferred embodiment according to the present invention.
Figure 2B:
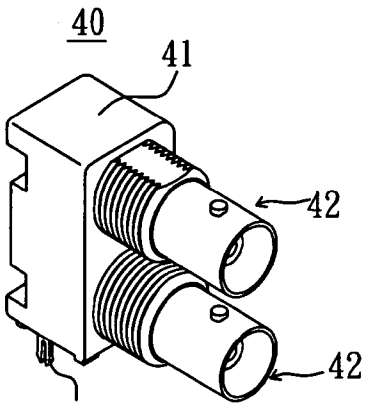
FIG. 2B is another perspective view, showing a dual type BNC connector of the second embodiment according to the present invention.

Please refer to FIGS. 2A to 2C. A dual type BNC connector 40 of a second preferred embodiment according to the present invention comprises a housing 41, two BNC plugs 42, a plurality of conducting wires 43, 44, 45 and 46 and an insertion element 47. The dual type BNC connector 40 is approximately the same as the dual type BNC connector 30 mentioned above, but a rear end of the housing 41 of the dual BNC connector 40 is only disposed with a first pick up plate 411. The first pick up plate 411 is disposed with a plurality of engagement grooves 412. The plurality of engagement grooves 412 are respectively engaged with the two conducting wires 43 and 44 to allow the plurality of conducting wires 43, 44, 45 and 46 to be respectively retained at specific positions, not to be inclined to influence the stability of the signal transmission and not to contact one another to form a short circuit. Moreover, the pins 431, 441, 451 and 461 of the plurality of conducting wires 43, 44, 45 and 46 are allowed to retain at positions corresponding to the plurality of slots of the circuit board to be convenient for allowing them to be respectively inserted into the plurality of slots on the circuit board simultaneously.

Figure 3C:
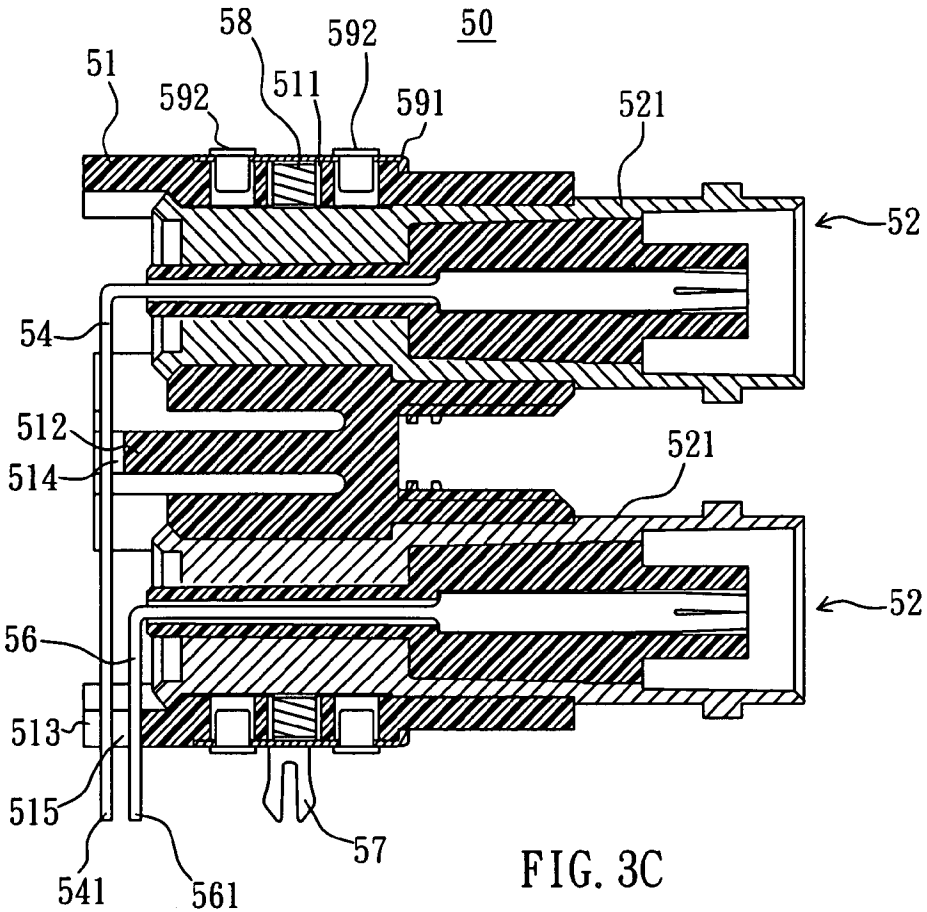
FIG. 3C is a cross sectional view, showing a dual type BNC connector of the third embodiment according to the present invention.
Figure 3A:
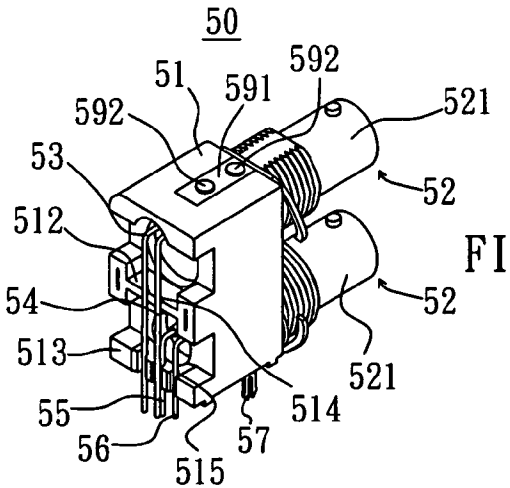
FIG. 3A is a perspective view, showing a dual type BNC connector of a third preferred embodiment according to the present invention.
Figure 3B:
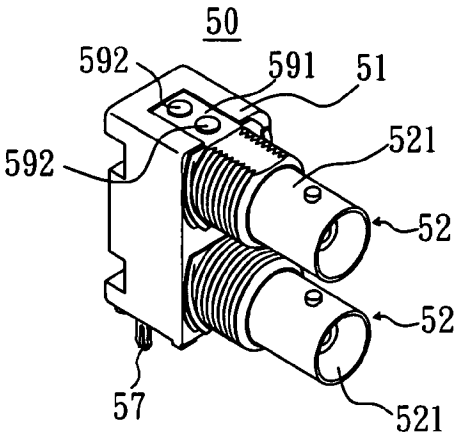
FIG. 3B is another perspective view, showing a dual type BNC connector of the third embodiment according to the present invention.

Please refer to FIGS. 3A to 3C. A dual type BNC connector 50 of a second preferred embodiment according to the present invention comprises a housing 51, two BNC plugs 52, a plurality of long conducting wires 53, 54 and short conducting wires 55 and 56 and an insertion element 57. The dual type BNC connector 50 is approximately the same as the dual type BNC connector 30 mentioned above, but the housing 51 of the dual type BNC connector 50 is disposed with a hole 511 for allowing a capacitor 58 to be assembled therein; a conducting sheet 591 is coupled to the housing 51 through two retaining elements 592 to shield the hole 511; one end of the capacitor 58 contacts a metal shell 521 and another end thereof contacts the conducting sheet 591. The capacitor 58 is used for filtering noise in electric signals. A rear end of the housing 51 of the dual type BNC connector 50 is disposed with a first pick up plate 512 at the middle section of the rear end and a second pick up plate 513 at the bottom of the rear end. The first pick up plate 512 and the second pick up plate 513 are respectively disposed with a plurality of first engagement grooves 514 and a plurality of second engagement grooves 515, and the first engagement grooves 514 is shorter than the second engagement grooves 515 as shows in FIG. 3C. The first engagement grooves 514 of the first pick up plate 512 are respectively engaged with the two long conducting wires 53 and 54; the second engagement grooves 515 of the second pick up plate 513 are respectively engaged with the long conducting wires 53, 54, and the short conducting wires 55 and 56 to allow the conducting wires 53, 54, 55 and 56 to be respectively retained at specific positions, not to be inclined to influence the stability of the signal transmission and not to contact one another to form a short circuit. Moreover, the pins 531, 541, 551 and 561 of the conducting wires 53, 54, 55 and 56 are allowed to retain at positions corresponding to the plurality of slots of the circuit, board to be convenient for allowing them to be respectively inserted into the slots on the circuit board simultaneously.

Figure 4C:
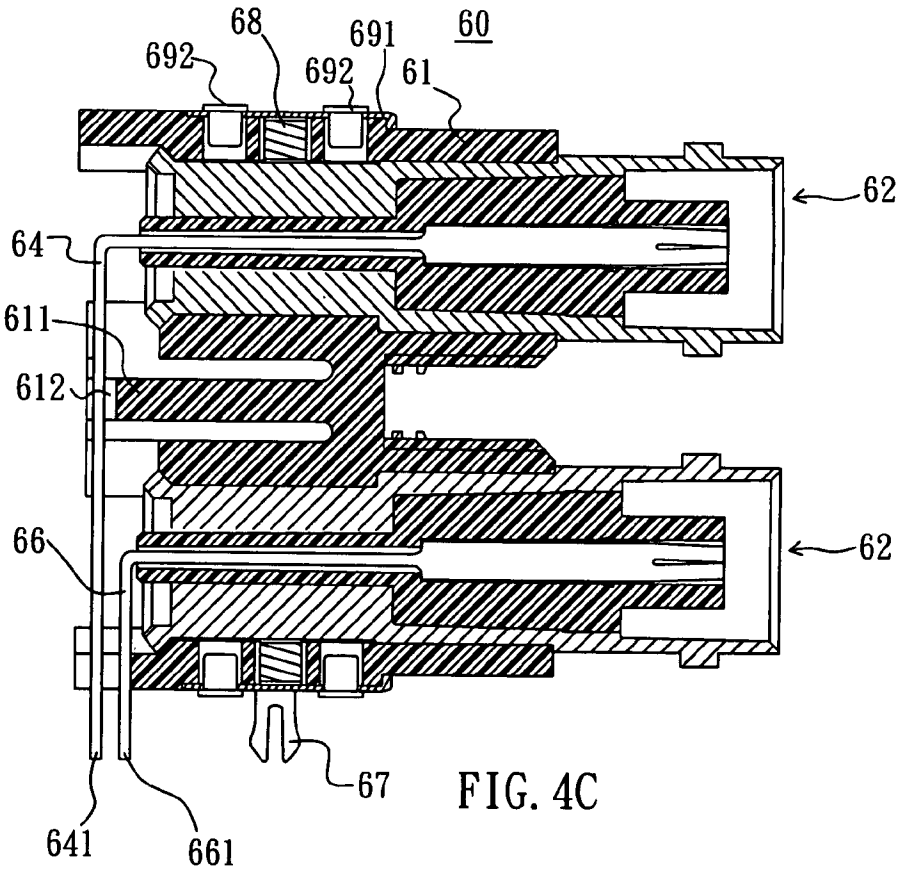
FIG. 4C is a cross sectional view, showing a dual type BNC connector of the fourth embodiment according to the present invention.
Figure 4A:
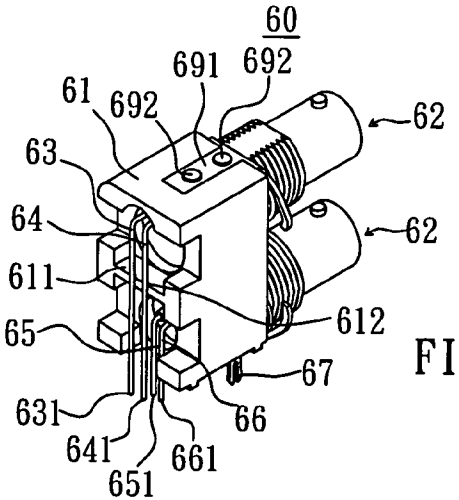
FIG. 4A is a perspective view, showing a dual type BNC connector of a fourth preferred embodiment according to the present invention.
Figure 4B:
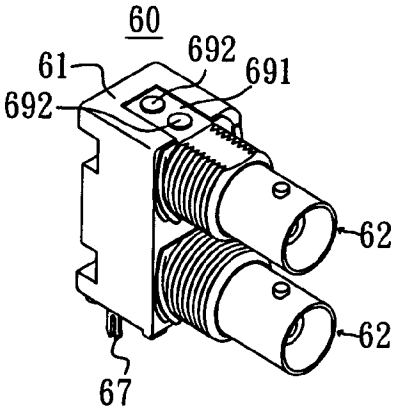
FIG. 4B is another perspective view, showing a dual type BNC connector of the fourth embodiment according to the present invention.

Please refer to FIGS. 4A to 4C. A dual type BNC connector 60 of a fourth preferred embodiment according to the present invention comprises a housing 61, two BNC plugs 62, a plurality of conducting wires 63, 64, 65 and 66, an insertion element 67, a capacitor 68, a conducting sheet 691 and two retaining elements 692. The dual type BNC connector 60 is approximately the same as the dual type BNC connector 50 mentioned above, but a rear end of the housing 61 of the dual BNC connector 60 is only disposed with a first pick up plate 611. The first pick up plate 611 is disposed with a plurality of engagement grooves 612. The plurality of engagement grooves 612 are respectively engaged with the two conducting wires 63 and 64 to allow the plurality of conducting wires 63, 64, 65 and 66 to be respectively retained at specific positions, not to be inclined to influence the stability of the signal transmission and not to contact one another to form a short circuit. Moreover, the pins 631, 641, 651 and 661 of the plurality of conducting wires 63, 64, 65 and 66 are allowed to retain at positions corresponding to the plurality of slots of the circuit board to be convenient for allowing them to be respectively inserted into the plurality of slots on the circuit board simultaneously.

Figures 5A, 5B:
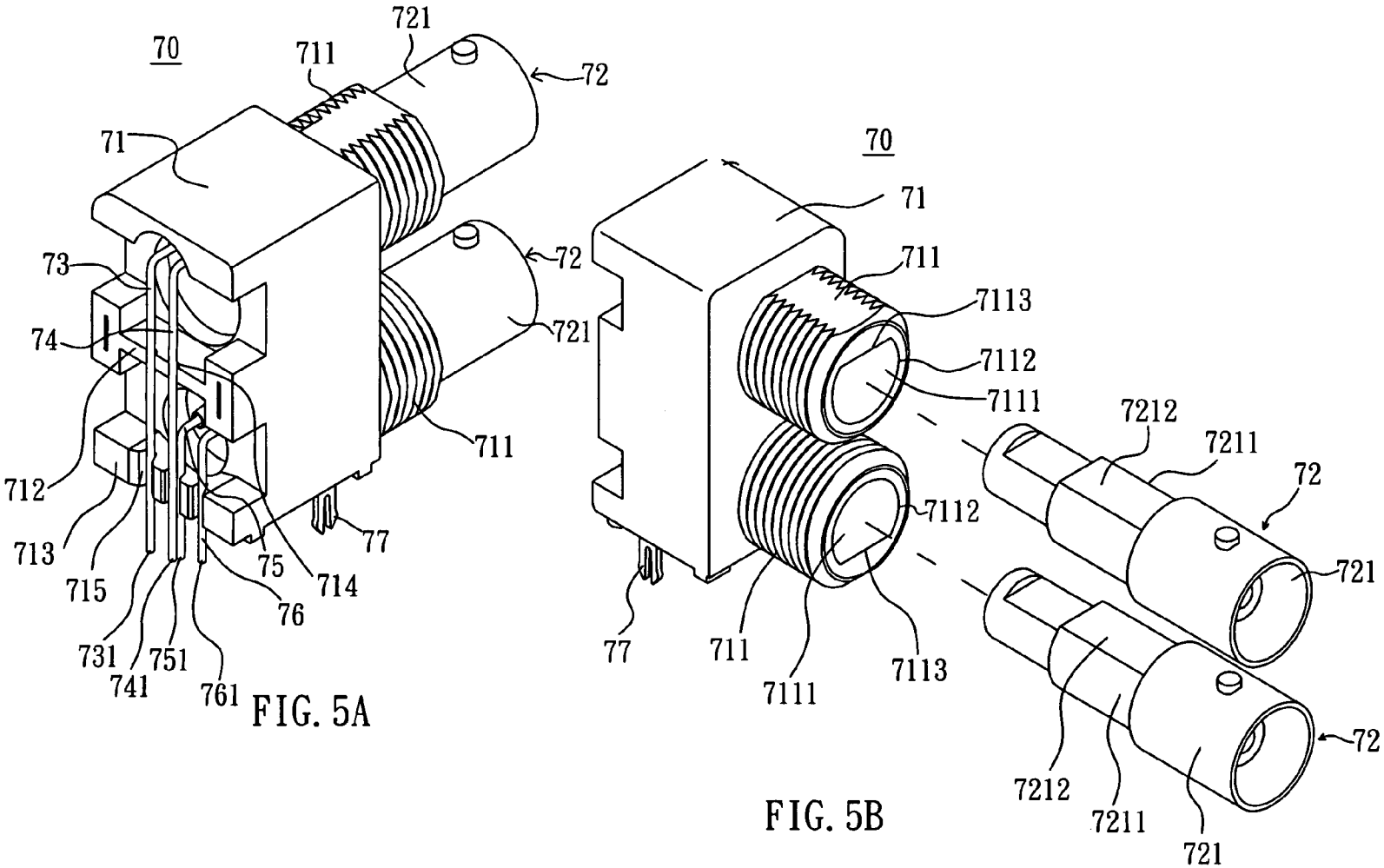
FIG. 5A is a perspective view, showing a dual type BNC connector of a fifth preferred embodiment according to the present invention.
FIG. 5B is schematic view, showing a housing of a dual type BNC connector not coupled to a BNC plug of the fifth embodiment according to the present invention.
Figure 6C:
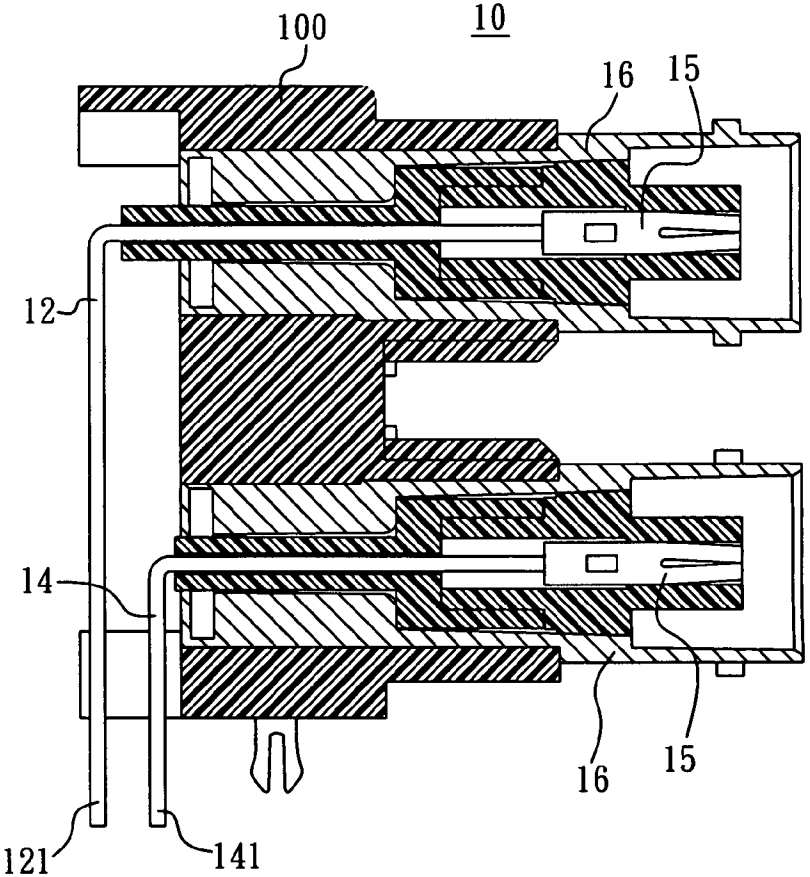
FIG. 6C (PRIOR ART)
FIG. 6C is a cross sectional view of a first conventional dual type BNC connector.
Figure 6A:
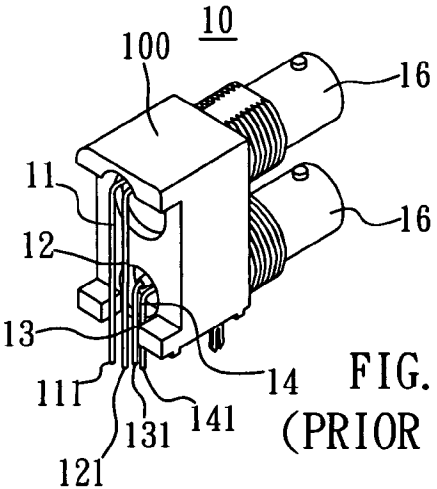
FIG. 6A (PRIOR ART)
FIG. 6A is a perspective view of a first conventional dual type BNC connector.
Figure 6B:
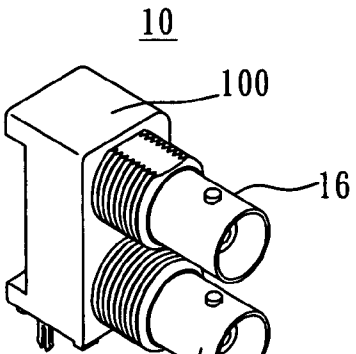
FIG. 6B (PRIOR ART)
FIG. 6B is another perspective view of a first conventional dual type BNC connector.
Figure 7C:
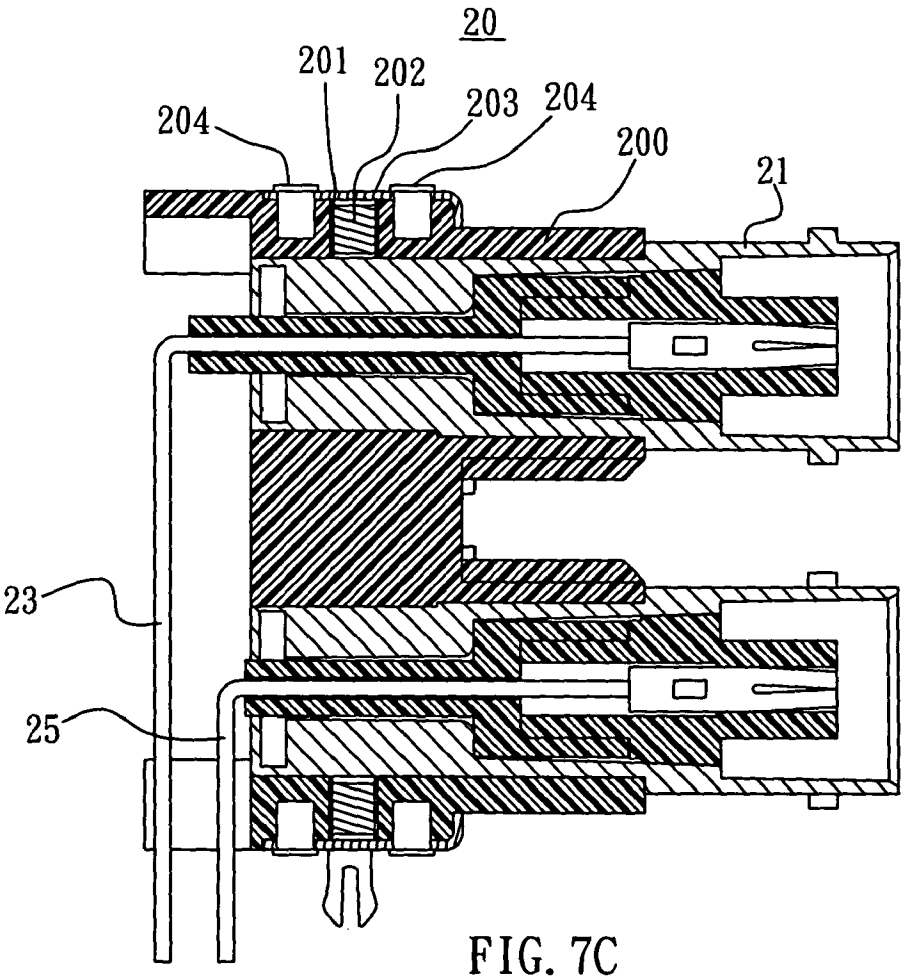
FIG. 7C (PRIOR ART)
FIG. 7C is a cross sectional view of a second conventional dual type BNC connector.
Figure 7A:
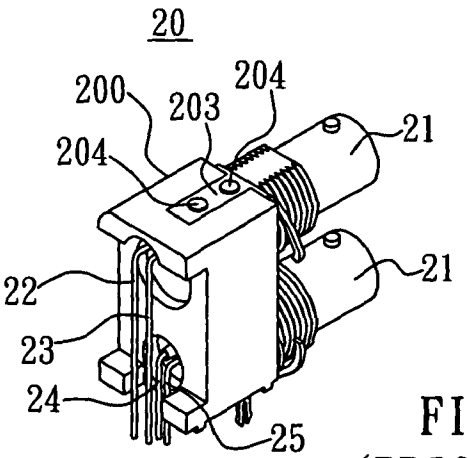
FIG. 7A (PRIOR ART)
FIG. 7A is a perspective view of a second conventional dual type BNC connector.
Figure 7B:
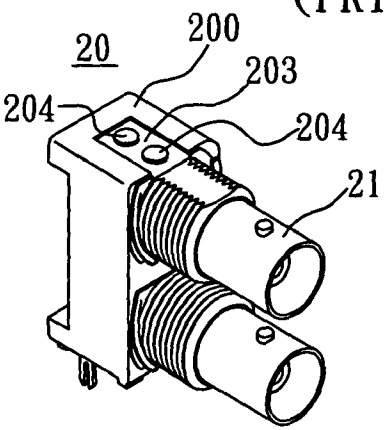
FIG. 7B (PRIOR ART)
FIG. 7B is another perspective view of a second conventional dual type BNC connector.

Please refer to FIGS. 5A to 5C. A dual type BNC connector 70 of a fifth preferred embodiment according to the present invention comprises a housing 71, two BNC plugs 72, a plurality of conducting wires 73, 74, 75 and 76 and an insertion element 77. The dual type BNC connector 70 is approximately the same as the dual type BNC connector 30 mentioned above, but a front end of the housing 71 of the dual type BNC connector 70 is disposed with two through holes 7111; the two through holes 7111 are respectively engaged with rear sections 7211 of a metal shell 721 of two BNC plugs 72. A wall 7112 of each through hole 7111 and the rear section 7211 of the metal shell 721 are respectively provided with corresponding interference sections 7113 and 7212 to allow the rear section 7211 not to be rotated in the through hole 7111. A rear end of the housing 71 of the dual type BNC connector 70 is disposed with a first pick up plate 712 and a second pick up plate 713. The first pick up plate 712 and the second pick up plate 713 are respectively disposed a plurality of engagement grooves 714 and a plurality of engagement grooves 715. The plurality of engagement grooves 714 of the first pick up plate 712 are respectively engaged with the two conducting wires 73 and 74; the plurality of engagement grooves 715 of the second pick up plate 713 are respectively engaged with the plurality of conducting wires 73, 74, 75 and 56 to allow the plurality of conducting wires 73, 74, 75 and 76 to be respectively retained at specific positions, not to be inclined to influence the stability of the signal transmission and not to contact one another to form a short circuit. Moreover, the pins 731, 741, 751 and 761 of the plurality of conducting wires 73, 74, 75 and 76 are allowed to retain at positions corresponding to the plurality of slots of the circuit board to be convenient for allowing them to be respectively inserted into the plurality of slots on the circuit board simultaneously.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A dual type BNC connector comprising:

an insulating housing having a rear end being disposed with a first pick up plate at the middle section thereof and a second pick up plate at the bottom thereof, the first pick plate having a plurality of first engagement grooves, and the second pick plate having a plurality of second engagement grooves;

two BNC plugs having a metal shell respectively, being parallel to each other, being coupled to said housing, and extending out of said housing;

a plurality of long conducting wires and short conducting wires having an end thereof being respectively electrically coupled to said two BNC plugs, and the other end thereof being respectively extending out of the housing to form a plurality of pins;

wherein said first engagement grooves are corresponding to and respectively engaged with said long conducting wires, and said second engagement grooves are corresponding to and respectively engage with said long conducting wires and said short conducting wires so as to retain said long conducting wires and said short conducting wires at a specific position respectively, wherein a distance between an outer end of the first pick up plate and the first engagement grooves is shorter than a distance between an outer end of the second pick up plate and the second engagement grooves for the long conducting wires being posited at a higher position than the short conducting wires and incapable of interfering with the short conducting wires such that a phenomenon of short circuit does not happen to enhance a stability of signal transmission.

2. The dual type BNC connector according to claim 1, wherein said housing has two holes with each of said holes accepting a capacitor; two conducting sheets are disposed to respectively couple to said housing to shield said two holes via two retaining elements, an end of said two capacitors respectively contacts said metal shell, and another end of said capacitors respectively contacts said two conducting sheets.

3. The dual type BNC connector according to claim 1, wherein said BNC plug further comprises a hollow insulator and a signal terminal; said metal shell has an inner part coupled to said insulator, and said insulator has an inner part coupled to said signal terminal; an end of each of said conducting wires is respectively electrically connected to said metal shell and said signal terminal.

4. The dual type BNC connector according to claim 2, wherein said BNC plug further comprises a hollow insulator and a signal terminal; said metal shell has an inner part coupled to said insulator, and said insulator has an inner part coupled to said signal terminal; an end of each of said conducting wires is respectively electrically connected to said metal shell and said signal terminal.

* * * * *